US007722158B2

(12) United States Patent
Niekawa

(10) Patent No.: US 7,722,158 B2
(45) Date of Patent: May 25, 2010

(54) INK-JET RECORDING APPARATUS

(75) Inventor: Yukihiro Niekawa, Tokyo (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 559 days.

(21) Appl. No.: 11/533,032

(22) Filed: Sep. 19, 2006

(65) Prior Publication Data

US 2007/0076076 A1 Apr. 5, 2007

(30) Foreign Application Priority Data

Oct. 5, 2005 (JP) ..... 2005-292165

(51) Int. Cl.
*B41J 2/15* (2006.01)
*B41J 2/155* (2006.01)

(52) U.S. Cl. ..... 347/42; 347/40; 347/41

(58) Field of Classification Search ..... 347/41, 347/102

See application file for complete search history.

(56) References Cited

U.S. PATENT DOCUMENTS 6,669,330 B2 * 12/2003 Vanhooydonck et al. ..... 347/41
2004/0119802 A1 * 6/2004 Yoneyama et al. ..... 347/102
2004/0145629 A1 7/2004 Silverbrook
2005/0190248 A1 9/2005 Konno et al.
2005/0200676 A1 * 9/2005 Kadomatsu et al. ..... 347/102

FOREIGN PATENT DOCUMENTS

| | | |
|---|---|---|
| DE | 10239002 | 3/2003 |
| EP | 1348565 | 1/2003 |
| EP | 1428669 | 6/2004 |
| EP | 1428670 | 6/2004 |
| JP | 2004-167812 | 6/2004 |
| JP | 2004-203025 | 7/2004 |
| JP | 2004-255818 | 9/2004 |

* cited by examiner

*Primary Examiner*—Matthew Luu
*Assistant Examiner*—Kendrick X Liu
(74) *Attorney, Agent, or Firm*—Lucas & Mercanti, LLP

(57) ABSTRACT

An ink-jet recording apparatus includes: a conveyance section which conveys a recording medium; a plurality of recording heads each aligned along a conveyance direction of the recording medium, which ejects the same kind of photo-curing type ink onto the recording medium conveyed by the conveyance section; and a plurality of light irradiating sections each aligned along the conveyance direction of the recording medium, which irradiates light onto the recording medium to which the photo-curing type ink has been ejected from each of the plurality of recording heads.

7 Claims, 7 Drawing Sheets

INK-JET RECORDING APPARATUS

This application is based on Japanese Patent Application No. 2005-292165 filed on Oct. 5, 2005, which is hereby incorporated by reference.

BACKGROUND OF THE INVENTION

The present invention relates to an ink-jet recording apparatus.

In the past, an ink-jet recording apparatus which ejects ink onto a recording medium, such as a sheet or a thin plastic plate, and records predetermined images, has been brought forth, and is now in practical use. Particularly, in recent years, greatly developed has been an ink-jet recording apparatus employing photo-curing type ink to record images onto an ink-non-absorbent recording medium, after which light rays irradiate the photo-curing type ink droplets deposited onto the recording medium, and forms the images. As such an ink-jet recording apparatus, developed is an ink-jet recording apparatus in which cation polymerizable photo-curing ink is used, and large amounts of light rays are irradiated at one time (for example, see Japanese Patent Application Publication Nos. 2004-203025, and 2004-255818).

In this ink-jet recording apparatus, for example, a single recording head for ejecting each color ink of Y (yellow), M (magenta), C (cyan) and K (black) is provided, and light irradiating sections are mounted downstream of each color recording head, with respect to conveyance direction of the recording medium. That is, after each color ink is deposited onto the recording medium, the light rays are irradiated onto each color ink from the light irradiating sections, and thereby, each ink is individually cured so that the images are recorded.

Further, in recent years, even when high resolution images are rapidly printed, in order to reduce a driving load of the recording head, an ink-jet recording apparatus using an interleave method has been developed, which records the images after thinned-out images are superimposed, (for example, see Japanese Patent Application Publication No. 2004-167812).

Meanwhile, in the ink-jet recording apparatus described in Japanese Patent Application Publication No. 2004-167812, plural recording heads for each color are provided, but as described above, due to the structure in which after each ink is deposited, the light irradiating sections irradiate light rays onto each ink, and each ink is individually cured, the problem is that each ink is separately deposited onto the recording medium, and the same colored ink droplets adjacent to each other pull at each other before curing. If such bleeding is generated, it may be impossible to obtain the desired quality images.

Further, since convex images are requested for the use of welfare or art, a "superposed ejection" method is used, in which the same colored ink droplets are repeatedly ejected to create the images. However, when the superposed ejection of the same color ink droplets is operated in the ink-jet recording apparatus, the deposited ink droplets expand widely, and the predetermined image quality cannot be obtained.

SUMMARY OF THE INVENTION

An object of the present invention is to offer an ink-jet recording apparatus in which bleeding is prevented and the high image quality is maintained, even when high speed printing is conducted onto the ink non-absorbent recording medium.

The above-described object can be attained by any one of Structures (1)-(7), described below.

Structure (1): An ink-jet recording apparatus including: a conveyance section to convey a recording medium; plural recording heads, aligned along a conveyance direction of the recording medium, each ejects the same type of photo-curing type ink onto the recording medium conveyed by the conveyance section; and plural light irradiating sections, aligned along the conveyance direction of the recording medium, each irradiates light rays onto the recording medium on which the photo-curing type ink has been ejected.

Structure (2): The ink-jet recording apparatus in Structure (1), further including: a first recording head, included in the plural recording heads, to eject the photo-curing type ink onto the recording medium conveyed by the conveyance section; a first light irradiating section, included in the plural light irradiating sections, to irradiate the light rays onto the recording medium on which the photo-curing type ink has been ejected from the first recording head; a second recording head, included in the plural recording heads, to eject the photo-curing type ink, which is the same type as the photo-curing type ink ejected from the first recording head, onto the recording medium on which the light rays have been irradiated from the first light irradiating section; and a second light irradiating section, included in the plural light irradiating sections, to irradiate the light rays onto the recording medium on which the photo-curing type ink has been ejected from the second recording head.

Structure (3): The ink-jet recording apparatus in Structure (2), wherein the first recording head and the second recording head include plural nozzles to eject the photo-curing type ink, and wherein the photo-curing type ink ejected from the nozzles of the second recording head, are deposited at a given position on the recording medium, that position is shifted a predetermined amount in at least one of the conveyance directions of the recording medium and a nozzle alignment direction, from a position at which the photo-curing type ink is ejected from the nozzles of the first recording head.

Structure (4): The ink-jet recording apparatus in Structure (3), wherein the recording head is driven by a multiple-phase driven method, and wherein nozzle arrays, structured of the integer multiple number of phases to be driven, are aligned within each of the recording heads, in the conveyance direction of the recording medium.

Structure (5): The ink-jet recording apparatus in Structure (4), wherein the number of phases to drive the recording heads is three, and wherein the recording heads are aligned in three lines in the conveyance direction of the recording medium.

Structure (6): The ink-jet recording apparatus in any one of Structures (3)-(5), wherein the plural nozzles of the recording heads are aligned in a line.

Structure (7): An ink-jet recording apparatus, including: a conveyance section to convey a recording medium; a first group of plural recording heads to eject photo-curing type ink of a first ink type onto the recording medium conveyed by the conveyance section; a second group of plural recording heads to eject photo-curing type ink of a second ink type onto the recording medium conveyed by the conveyance section; a first group of plural light irradiating sections to irradiate light rays onto the recording medium on which the photo-curing type ink has been ejected from the first group of the plural recording heads; and a second group of plural light irradiating sections to irradiate light rays onto the recording medium on which the photo-curing type ink has been ejected from the second group of the plural recording heads.

DETAILED DESCRIPTION OF THE PREFERRED EMBODIMENT

Figure 1:
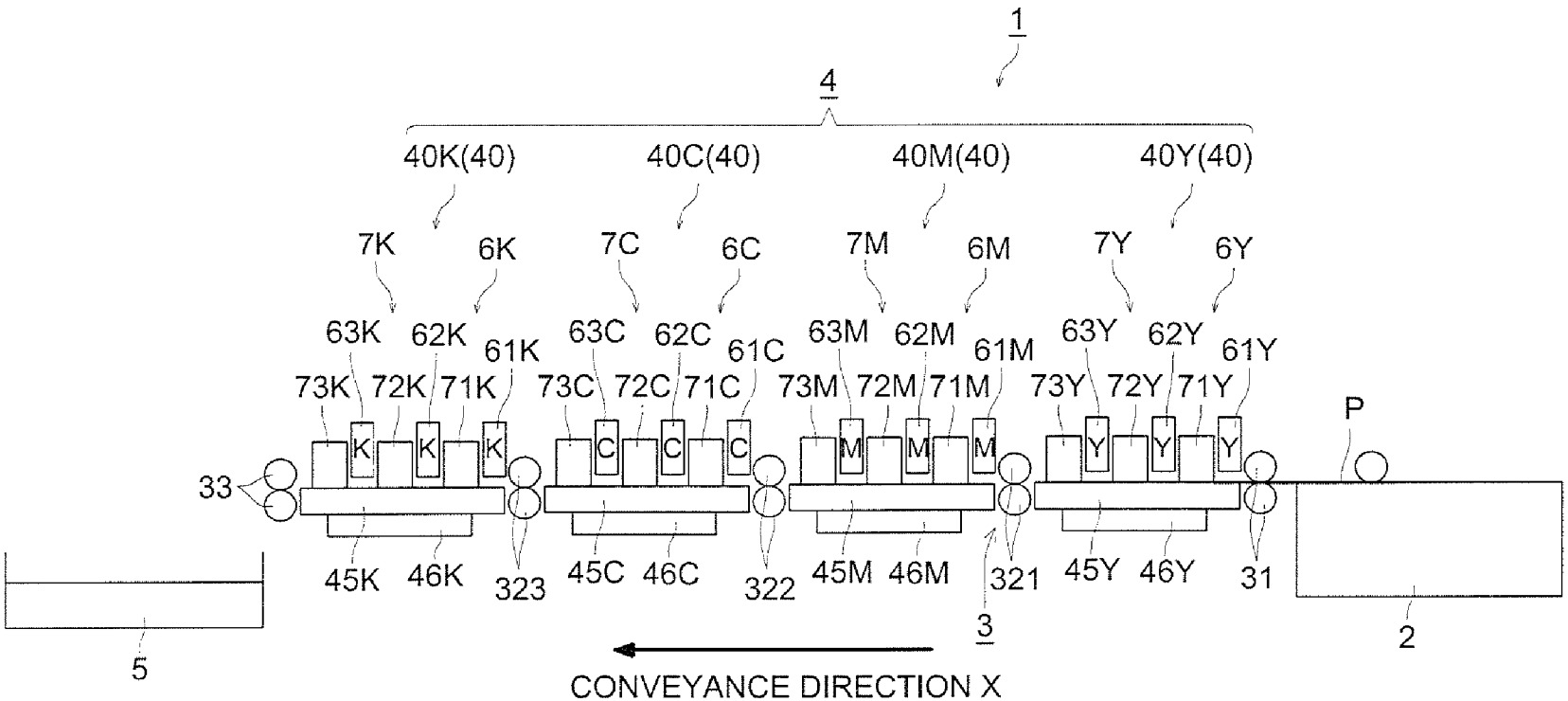
FIG. 1 shows a side view of the schematic structure of the ink-jet recording apparatus of the present embodiment.

The ink-jet recording apparatus in the present embodiment will now be detailed while referring to the drawings. FIG. 1 shows a side view of the schematic structure of the ink-jet recording apparatus. As shown in FIG. 1, ink-jet recording apparatus 1 includes: sheet supplying tray 2 to supply recording medium P, being an ink non-absorbent type sheet, such as a PET, conveyance section 3 to convey recording medium P stored in sheet supplying tray 2; image recording section 4 to record the images onto recording medium P conveyed by conveyance section 3; and sheet ejection tray 5 to store recording medium P, carrying the recorded images, ejected by conveyance section 3.

Conveyance section 3 includes: paired conveyance rollers 31 to convey uppermost recording medium P stored in sheet supplying tray 2 into image recording section 4; plural paired conveyance rollers 321, 322 and 323 disposed on the conveyance route of recording medium P, to convey recording medium P; and paired ejection rollers 33 located on a downstream end of image recording section 4 which is positioned on the most downstream with respect to the conveyance route of recording medium P, to eject recording medium P carrying the recorded images onto sheet ejection tray 5.

Image recording section 4 includes plural image recording units 40 which record superposed color images onto recording medium P, using the plural types of photo curing type ink. Plural image recording units 40 include: yellow unit 40Y to form yellow image potions onto recording medium P using yellow (Y) photo-curing type ink, magenta unit 40M to form magenta image portions onto recording medium P using magenta (M) photo-curing type ink, cyan unit 40C to form cyan image portions onto recording medium P using cyan (C) photo-curing type ink, and black unit 40K to form black image portions onto recording medium P using black (K) photo-curing type ink, wherein from the upstream end to the downstream end of the conveyance route of recording medium P, yellow unit 40Y, magenta unit 40M, cyan unit 40C and black unit 40K are aligned in that order.

Further, each image recording unit 40 includes: platens 45Y, 45M, 45C and 45K to support recording medium P from below which was conveyed by conveyance section 3; and heaters 46Y, 46M, 46C and 46K located under platens 45Y, 45M, 45C and 45K, to heat recording medium P on platens 45Y, 45M, 45C and 45K.

Additionally, in the following description, image recording unit 40 will be explained in a case of yellow unit 40Y, and explanation for magenta unit 45M, cyan unit 45C and black unit 45K will be omitted, while the symbols of each color about the structural elements are shown after each numeral designation.

Above platen 45Y of yellow unit 40Y, recording heads 6Y, being a line method and multiple-phase drive type, are aligned perpendicular to the conveyance direction, and are themselves aligned in parallel. In detail, recording head 6Y is activated by a three-phase drive method, and the number of provided recording heads 6Y is an integer multiple of the number of the phases of recording heads 6Y, and in this case, as one multiple of the number of the phase, three recording heads 61Y, 62Y and 63Y are aligned in parallel, to which the yellow photo-curing type ink of the same ink type is supplied from an ink tank, which is not illustrated. Recording head 61Y is the first recording head relating to the present invention, while other recording heads 62Y and 63Y are the second recording heads relating to the present invention. Further, three recording head groups 6Y are the first recording heads groups relating to the present invention, while the other recording head groups 6M, 6C and 6K are the second recording head groups. Additionally, in the present embodiment, it is assumed that the ink as the same type is supplied from the same tank of ink, but a structure is also possible so that the same color ink is supplied to each recording head from the individual ink tanks. Further, it is also possible that the composition of color ink supplied from each ink tank is different each other, so that additives, pigments and solvent can be changed in each color ink.

Figure 2:
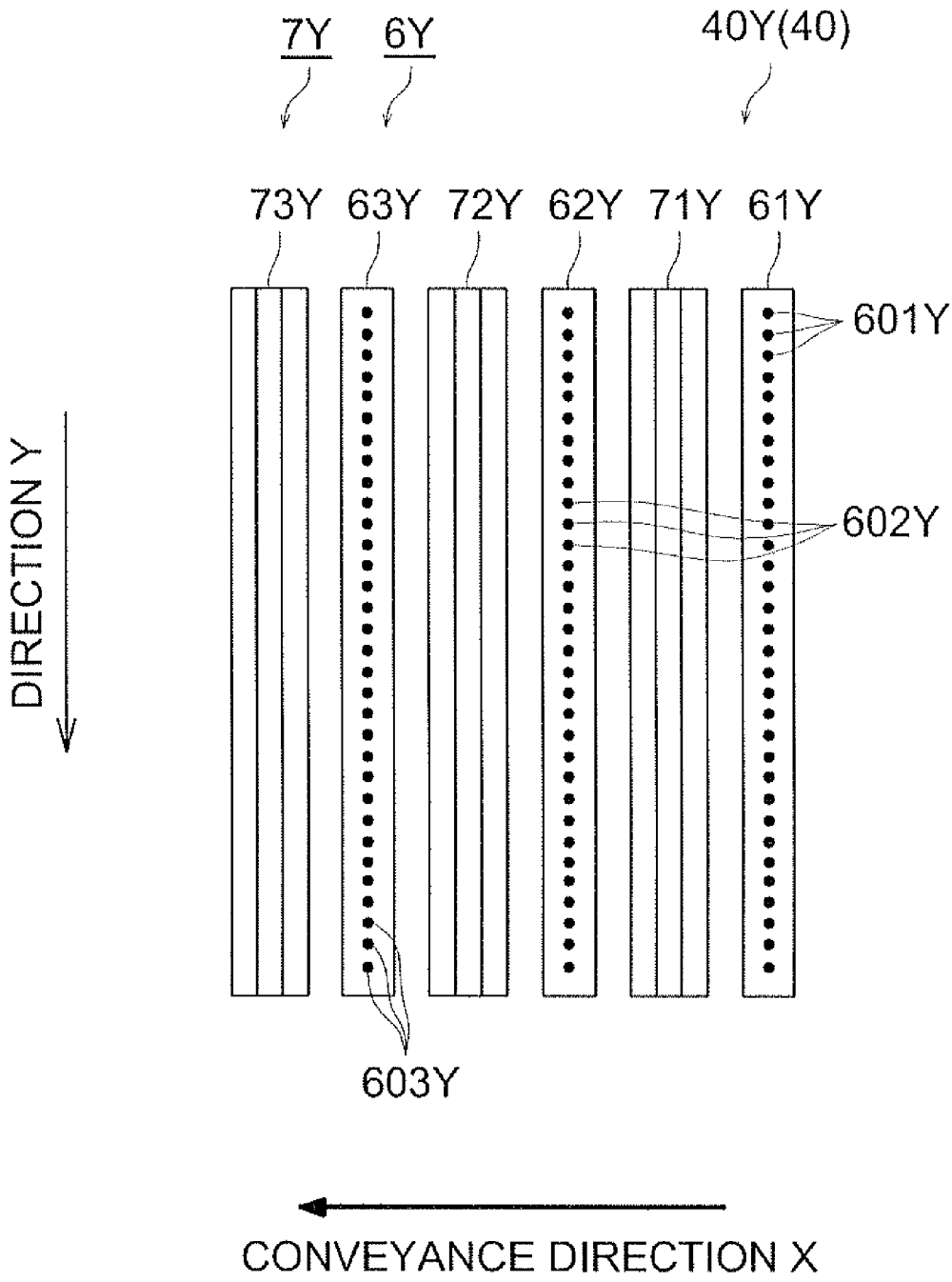
FIG. 2 is a bottom surface view showing the schematic structure of the image recording unit provided in the ink-jet recording apparatus of FIG. 1.

Next, FIG. 2 is a bottom view showing the schematic structure of yellow unit 40Y, and as shown in FIG. 2, plural nozzles 601Y, 602Y and 603Y to eject the photo-curing type ink are aligned on jetting surfaces of recording heads 61Y, 62Y and 63Y, perpendicular to the sheet conveyance direction. Nozzles 601Y, 602Y and 603Y assembled in recording heads 61Y, 62Y and 63Y are aligned along the direction in which recording heads 61Y, 62Y and 63Y are located, that is, they are aligned in the direction (arrow Y) perpendicular to the conveyance direction (arrow X) of recording medium P. Further, the position of nozzle 601Y aligned in recording head 61Y, the position of nozzles 602Y aligned in recording head 62Y and the position of nozzles 603Y aligned in recording head 63Y coincide with each other with respect to the sheet conveyance direction.

Yet further, plural light irradiating sections 7Y are provided immediately downstream of each recording head 6Y with respect to the conveyance direction in yellow unit 40Y, and irradiate ultraviolet rays to the photo-curing type ink deposited on recording medium P to cure it. In detail, light irradiating section 71Y is located immediately downstream of the most upstream recording head 61Y, and further, light irradiating section 72Y is located immediately downstream of recording head 62Y, and similarly light irradiating section 73Y is located immediately downstream of most downstream recording head 63Y. That is, light irradiating section 71 is the first light irradiating section of the present invention, while other light irradiating sections 72Y and 73Y are the second light irradiating sections relating to the present invention.

Figure 3:
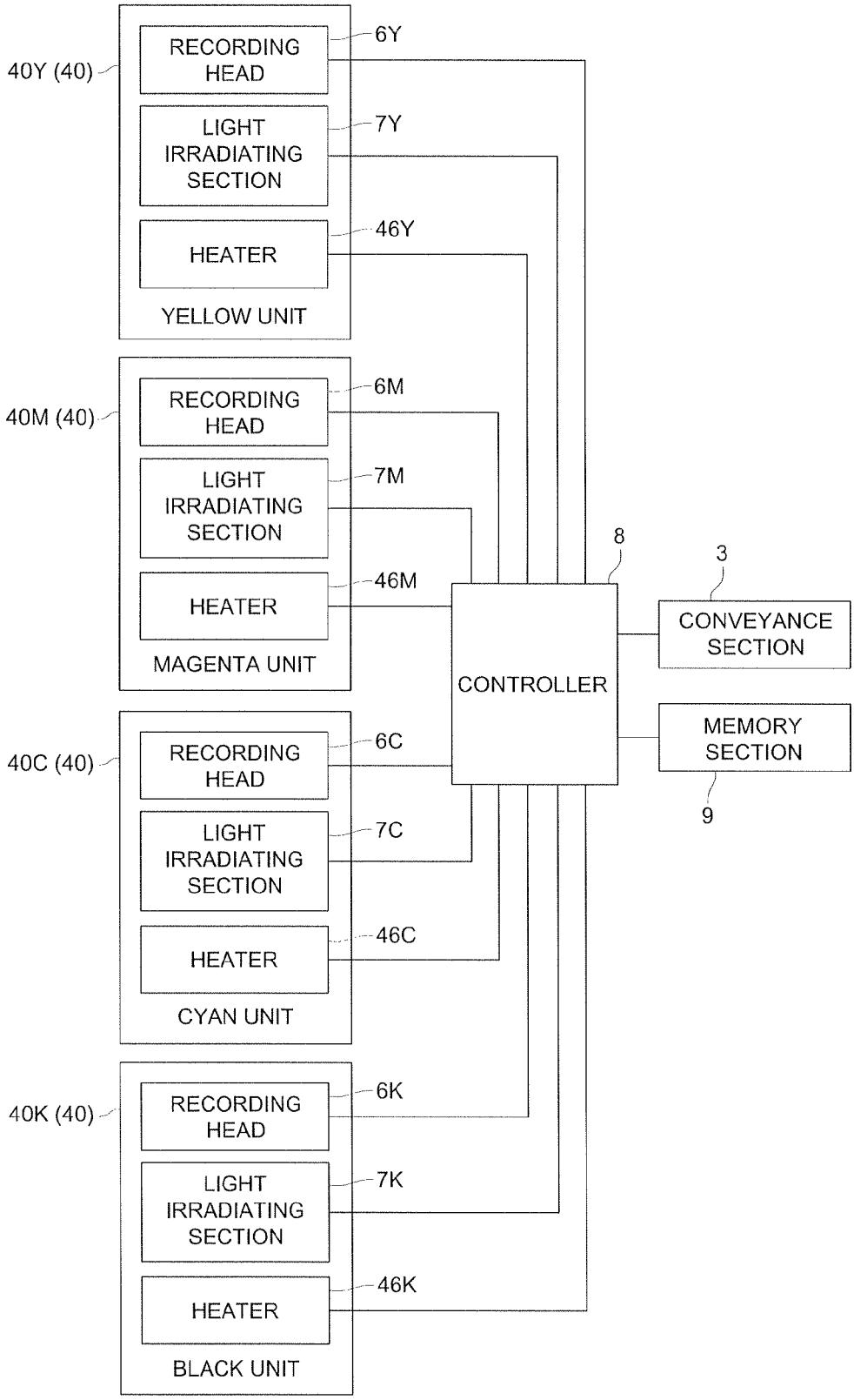
FIG. 3 is a block diagram showing the main control structure of the ink-jet recording apparatus of FIG. 1.

FIG. 3 is a block diagram showing a main control structure of ink-jet recording apparatus 1. As shown in FIG. 3, ink-jet recording apparatus 1 includes control section 8 to control each driving section. Memory section 9 memorizes a specific control program and the respective image data, to control recording head groups 6Y, 6M, 6C and 6K of each recording unit 40, light irradiating sections 7Y, 7M, 7C and 7K, and heaters 46Y, 46M, 46C and 46K, all of which are electrically connected to control section 8. Control section 8 reads out the control program and the image data from memory section 9, and executes them so that all driving sections are controlled.

Figure 4:
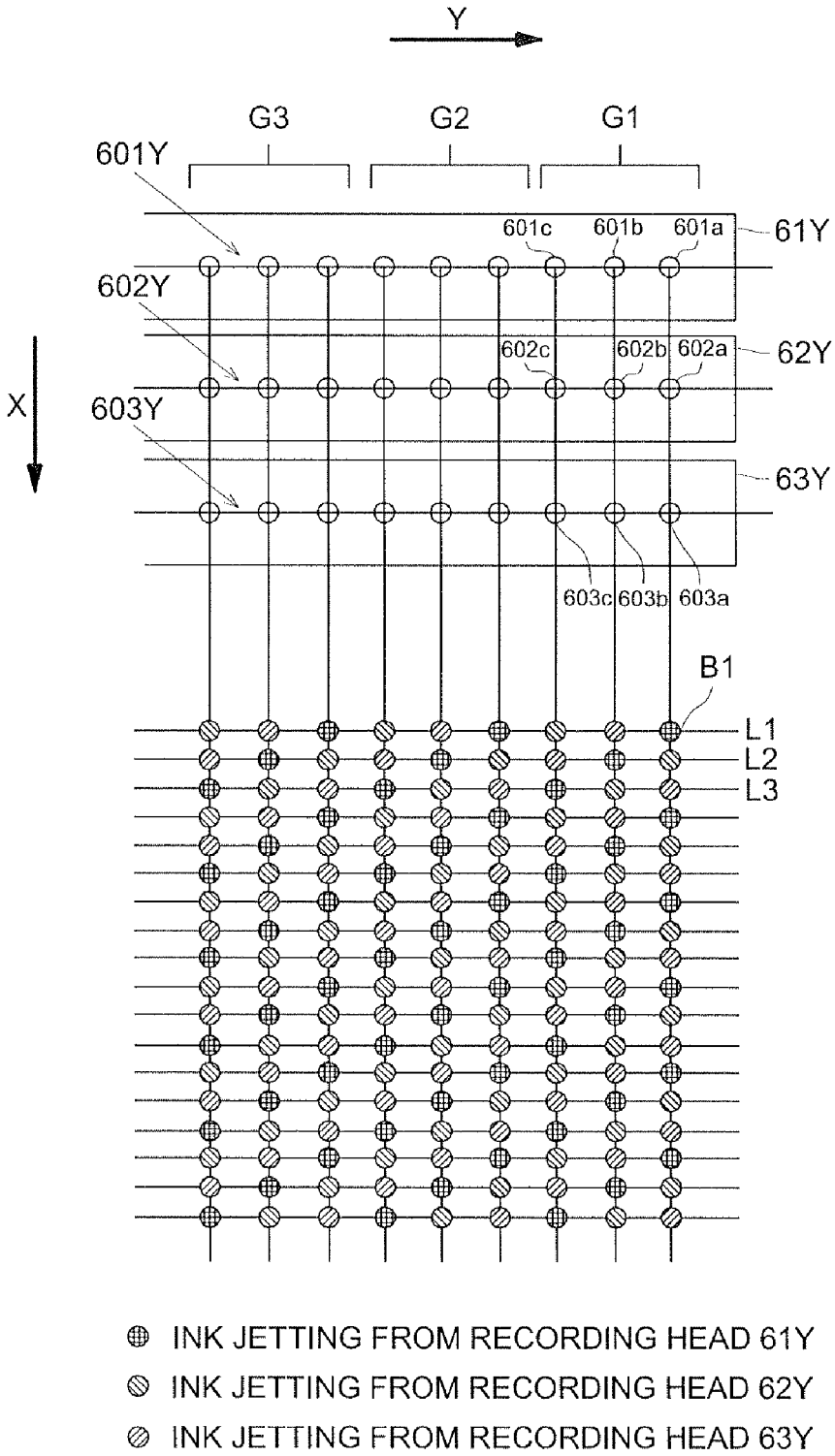
FIG. 4 is a pattern diagram showing the relationship between each nozzle of the recording heads provided in the image recording unit of FIG. 2 and positions at which ink ejected from each nozzle was deposited.

Next, referring to FIG. 4, the control of ink-jetting of the present embodiment will be detailed, while using yellow unit 40Y for the explanation. FIG. 4 is a pattern diagram showing the relationship between each nozzle 601Y, 602Y and 603Y of recording heads 61Y, 62Y and 63Y and the positions at which ink ejected from each nozzle 601Y, 602Y and 603Y is deposited, relating to the present embodiment, which is an example of the control conducted by control section 8. In addition, the positions at which the ink ejected from each nozzle 601Y, 602Y and 603Y is deposited are controlled by ink-jet timing from each nozzle 601Y, 602Y and 603Y. Further, ink-ejection timing is adjusted based on the positional intervals of each recording head 61Y, 62Y and 63Y, as well as the conveyance rate of recording medium P.

In three-phase drive recording heads 61Y, 62Y and 63Y of the present embodiment, since nozzles 601Y, 602Y and 603Y are grouped in one group, from right to left in FIG. 4, "a", "b" and "c" are added at the end of the numerals, for convenience of this explanation. Nozzles 601*a*, 602*a* and 603*a* of recording heads 61Y, 62Y and 63Y are controlled to eject the ink during the first phase, and further, nozzles 601*b*, 602*b* and 603*b* are controlled to eject the ink during the second phase, and nozzles 601*c*, 602*c* and 603*c* are controlled to eject the ink during the third phase. That is, three adjacent nozzles (for example, nozzles 601*a*, 601*b* and 601*c*) always eject ink at different times. Additionally, since the present embodiment shows the three-phase drive, three-phase group G1 is explained, while the other groups G2 and G3 are omitted for this explanation, because groups G2 and G3 are synchronized with group G1.

In the present embodiment, nozzles 601Y, 602Y and 603Y are controlled to start ink-ejection at a position which is shifted in the conveyance direction by the width of a picture element (which is one picture element) for each phase. That is, in the present embodiment, the ink droplets ejected from nozzles 601*a*, 602*b* and 603*c* are deposited approximately at position L1 in conveyance direction X, while the ink droplets ejected from nozzles 601*b*, 602*c* and 603*a* are deposited at position L2, and the ink droplets ejected from nozzles 601*c*, 602*a* and 603*b* are deposited at position L3. In this way, in recording head 61Y, the phase is changed by rotation for nozzles 601*a*, 601*b* and 601*c* and direction Y, and thereby, recording is conducted for each phase from adjacent picture elements in conveyance direction X.

That is, recording heads 61Y, 62Y and 63Y form the images which are reduced by one third in direction Y by control section 8, and after all of these reduced images are formed, a complete yellow image is formed. Due to this structure, the working frequencies of recording heads 61Y, 62Y and 63Y become one third of one-phase drive recording head, which makes it possible to rapidly form the high resolution images. In addition, for ejecting the ink at the same position, the ink droplets ejected from nozzles 601*a*, 602*a* and 603*a* are controlled to be deposited at the same position (for example, B1 in FIG. 4).

Next, the function of ink-jet recording apparatus 1 of the present embodiment will be detailed below.

When image recording is started, control section 8 controls conveyance section 3 to rotate paired conveyance rollers 31 and conveyance rollers 321, 322 and 323, so that recording medium P is conveyed from sheet supplying tray 2. At the same time, control section 8 controls heaters 46Y, 46M and 46C to heat recording medium P which is fed onto platens 45Y, 45M, 45C and 45K.

Further, control section 8 controls conveyance section 3 to rotate conveyance roller 321 to convey recording medium P, and based on the image data, control section 8 also controls recording head 61Y which is the most upstream in yellow unit 40Y, so that the yellow photo-curing type ink is ejected from one nozzle every three nozzles in the alignment direction of the nozzles. Yet further, control section 8 controls light irradiating section 71Y, which is the most upstream, to activate light irradiating section 71Y. Due to this, the yellow photo-curing type ink deposited by recording head 61Y which is the most upstream is cured.

Yet further, based on the image data, control section 8 controls recording head 62Y which is at the midstream of yellow unit 40Y, so that the yellow photo-curing type ink is ejected to the position shifted by one image element from recording head 61Y, but at the same position in the conveyance direction, from one nozzle every three nozzles in the alignment direction of the nozzles, and thereby, the yellow photo-curing type ink is ejected to the position to which no yellow photo-curing type ink is ejected from recording head 61Y which is the most upstream. Yet further, control section 8 controls light irradiating section 72Y, which is the midstream, to activate light irradiating section 72Y. Accordingly, the yellow photo-curing type ink deposited by recording head 62Y, which is the midstream, is cured.

After which, based on the image data, control section 8 controls recording head 63Y which is the most downstream in yellow unit 40Y, so that the yellow photo-curing type ink is ejected to the position shifted by two image elements from recording head 61Y, but at the same position in the conveyance direction, from one nozzle every three nozzles on the alignment direction of the nozzles, and thereby, the yellow photo-curing type ink is ejected to the positions at which no yellow photo-curing type ink is ejected from recording heads 61Y and 62Y which are the most upstream and the midstream, respectively. Yet further, control section 8 controls light irradiating section 73Y, which is the most downstream, to activate light irradiating section 73Y. Accordingly, the yellow photo-curing type ink deposited by recording head 63Y, which is the most downstream, is cured.

Figure 5:
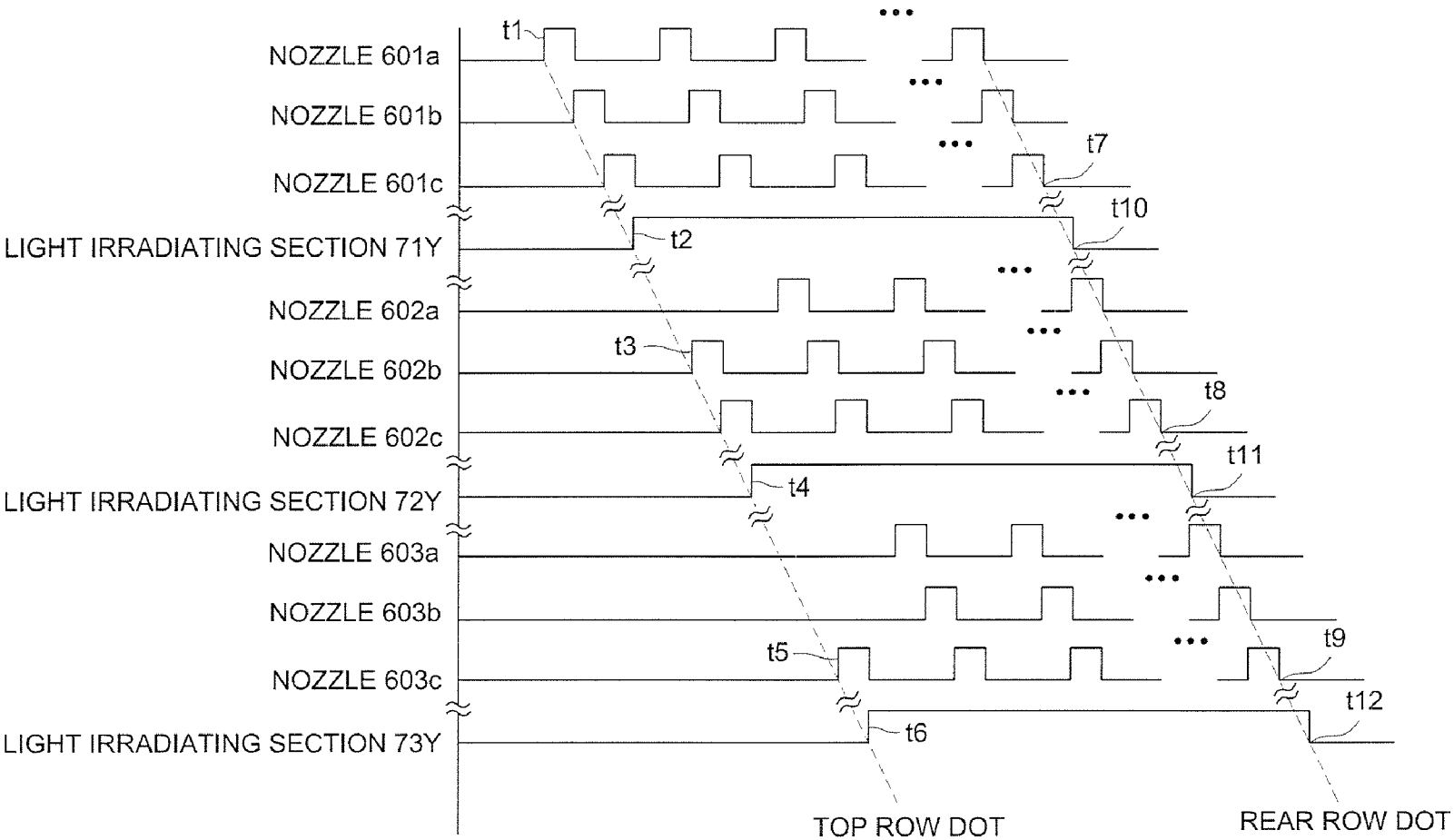
FIG. 5 is a timing chart showing ejection timing of each nozzle and light rays irradiation timing during an ink-ejection control.

FIG. 5 is a timing chart showing the ejection timing of each nozzle and the light-ray irradiation timing in the above procedure. As shown in FIG. 5, after top row dots (being L1 in FIG. 4) in conveyance direction X are formed by nozzle 601*a* of recording head 61Y (at t1), light irradiating section 71Y, which is located immediately downstream of recording head 61Y, emits light rays (at t2). Next, after top row dots L1 in conveyance direction X are formed by nozzle 602*b* of recording head 62Y (at t3), light irradiating section 72Y, which is located immediately downstream of recording head 62Y, emits light rays (at t4). Further, after the top row dots L1 in conveyance direction X are formed by nozzle 603*c* of recording head 63Y (at t5), light irradiating section 73Y, which is located immediately downstream of recording head 63Y, emits light rays (at t6).

Yet further, after end row of dots in conveyance direction X are formed by nozzles 601*c*, 602*c* and 603*c* of recording heads 61Y, 62Y and 63Y (at t7, t8, and t9), light irradiating sections 71Y, 72Y and 73Y are de-activated (at t10, t11 and t12).

After the yellow image recording portions of the yellow photo-curing type ink are completed, control section 8 controls recording head 6 and light irradiating section 7 of image recording units 40 (which are magenta unit 40M, cyan unit 40C and black unit 40K) to operate in the same way as above-described yellow 40Y, and thereby, full color images are recorded on recording medium P by yellow, magenta, cyan and black photo-curing type inks.

After that, control section 8 controls conveyance section 3 to rotate paired conveyance rollers 33 to eject recording medium P carrying the full color recorded images to sheet ejection tray 5.

As described above, based on ink-jet recording apparatus 1 of the present embodiment, after the photo-curing type inks are deposited onto recording medium P, light rays are irradiated onto recording medium P onto which photo-curing type inks have been ejected from the recording heads of plural recording head groups 6Y, 6M, 6C and 6K which jet the same types of photo-curing type ink, that is, in the condition that the photo-curing type ink deposited on recording medium P has been cured, the same type of the photo-curing type ink is ejected onto recording medium P from the other recording heads. Accordingly, those inks are not mixed and prevented from bleeding, which result in extremely high quality images.

Further, since light irradiating sections 7Y, 7M, 7C and 7K are located immediately downstream of recording head groups 6Y, 6M, 6C and 6K with respect to the conveyance direction, the photo-curing type inks ejected from each recording head can be individually and immediately cured.

In addition, the recording head is driven by the multiple-phase drive method, and since the recording heads are provided which are structured of the integer multiples of the number of the drive phase, when recording medium P passes each recording head for a single time, image recording of the total picture elements can be conducted.

Yet further, since the recording heads are driven by the multi-phase drive method, and which are mounted as the multiple number of the drive phase, after recording medium P passes each recording head only once, a complete image element can be recorded.

In addition, it is a matter of course that the present invention is not limited to the above-description, and is possible to be changed. In the following explanation, concerning the sections which are the same as the sections of the present embodiment, the same symbol is used and its explanation is omitted.

Figure 6:
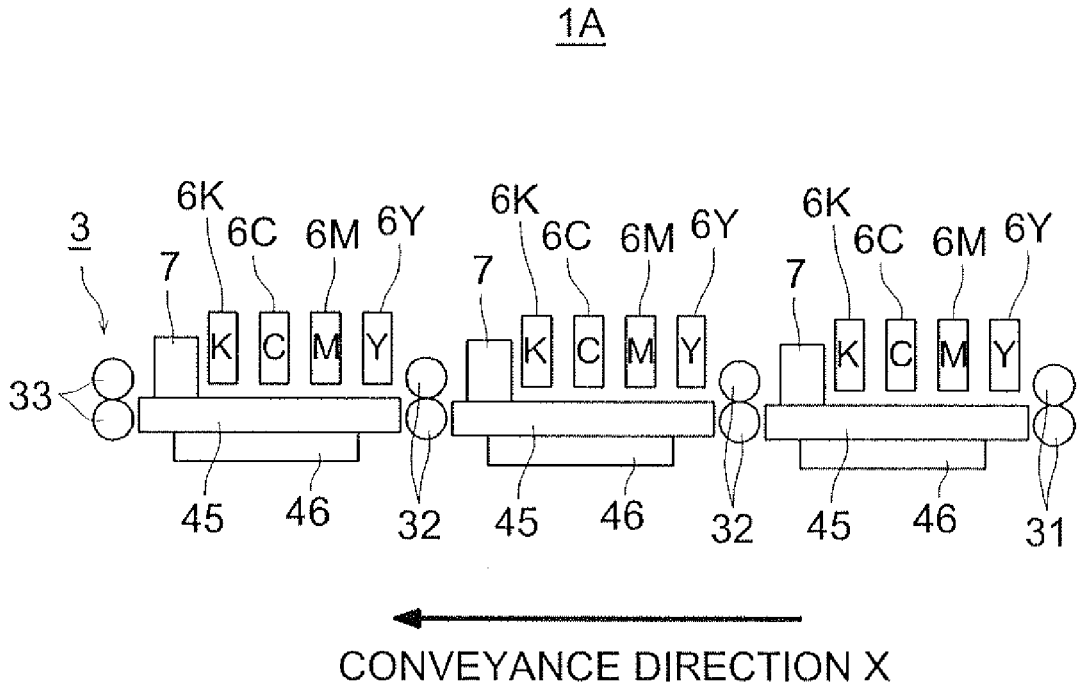
FIG. 6 is a side view showing a variation of the ink-jet recording apparatus of FIG. 1.

For example, in the present embodiment, the case is explained in which light irradiating sections 7Y, 7M, 7C and 7K are mounted immediately downstream of each recording head 6Y, 6M, 6C and 6K, however as shown in FIG. 6, irradiating section 7 can be mounted at only the position which is immediately downstream of recording heads 6Y, 6M, 6C and 6K, each arranged in one group. To specifically explain, in ink-jet recording apparatus 1A shown in FIG. 6, three groups of linear type recording heads 6Y, 6M, 6C and 6K are aligned in the recording medium conveyance direction, wherein each line type recording head includes yellow, magenta, cyan and black photo-curing type inks, so that each color is ejected onto the recording medium P in three steps to form the images. Even in the above linear position of recording heads 6Y, 6M, 6C and 6K, the photo-curing type ink of each group are simultaneously cured after each ink is ejected.

Accordingly, plural types of photo-curing type ink are grouped, and each ink of the group is ejected "n" times to form the images on the recording medium P, that is, it is possible to form the images by superposing the same type of ejected photo-curing type ink for "n" layers. Further, since plural light irradiating sections 7 are provided to cure the plural types of photo-curing type ink for each group, ink for each layer can be cured individually, and ink is prevented from blending. In other words, even when the images are superposed of the same type of ink for plural layers, the ink can be cured, while an even thickness of ink of each layer is assured.

Yet further, in the present embodiment, the case in which the recording heads of each color are driven by three-phase drive method, and three recording heads are provided, is an example for the explanation, however, the number of the drive phases of the recording heads is not limited to three, that is, as long as the number of the recording heads is the integer multiples of the number of the drive phase, any number can be used. In addition, the ejecting steps are also not limited to three, and any plural number can be employed.

Figure 7:
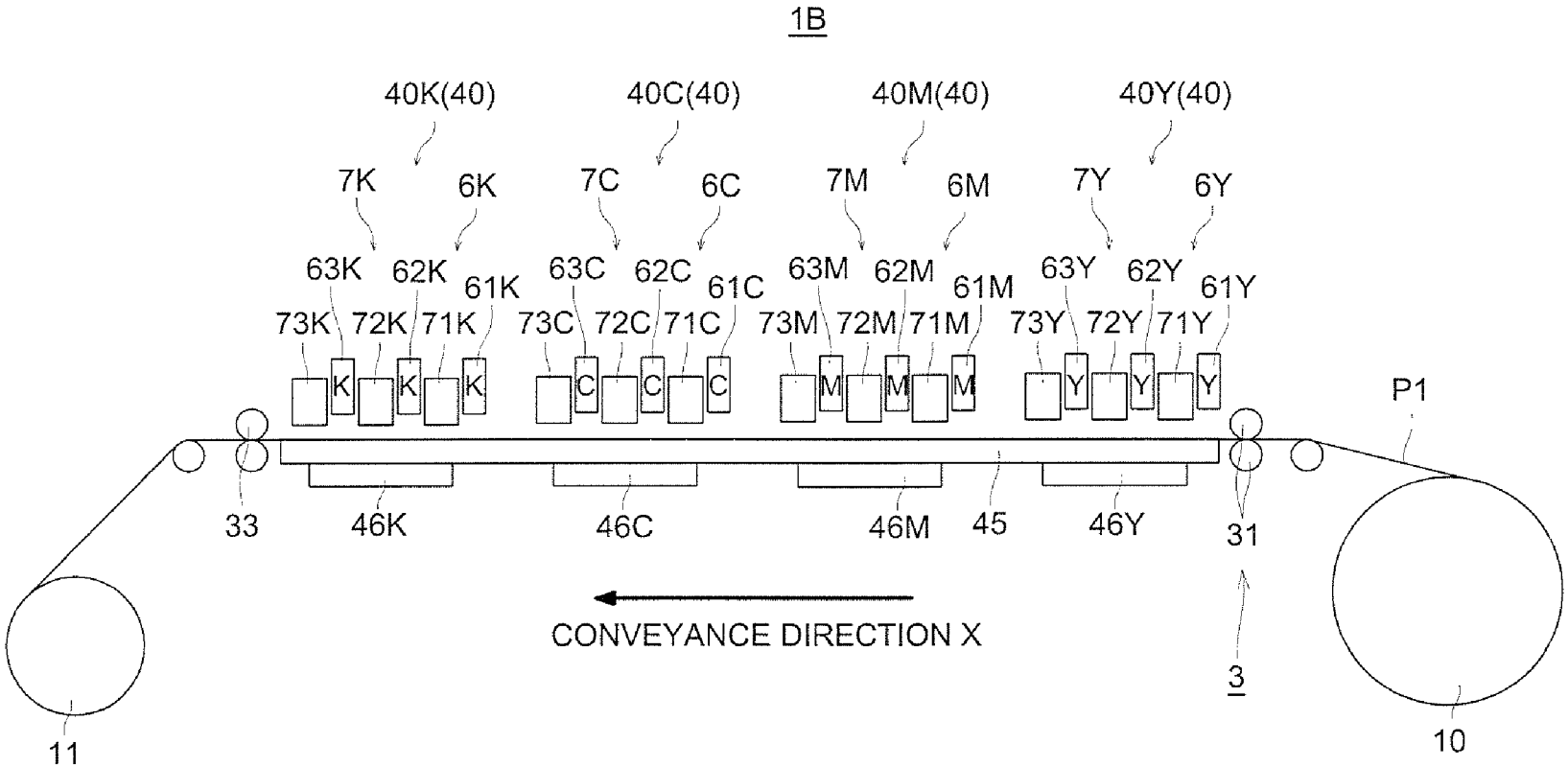
FIG. 7 is a side view showing another variation of the ink-jet recording apparatus of FIG. 1.

Yet further, in the present embodiment, the case in which the images are recorded on cut sheets of recording medium P has been explained, however, it is also possible to form the images on rolled recording medium P. For example, ink-jet recording apparatus 1B shown in FIG. 7, includes: supporting section 10 to provide continuous recording medium P1, and to control conveyance device 3 to take up recording medium P1, mounted in the upstream of conveyance device 3 with respect to the conveyance direction; and take-up section 11 to take up rolled recording medium P1 at the downstream end of conveyance device 3. Rolled recording medium P1 carrying the full color images is taken up by take-up section 11.

According to the present embodiment, after the photo-curing type inks are deposited onto the recording medium, light rays are irradiated onto the recording medium onto which photo-curing type inks have been ejected from the recording heads which eject the same types of photo-curing type ink, and thereby, under the condition that the photo-curing type ink deposited on the recording medium has been cured, the same type of the photo-curing type ink is ejected onto the recording medium from the other recording heads. Thus, those ink are not mixed and prevented from bleeding, resulting in extremely high quality images.

What is claimed is:

1. An ink-jet recording apparatus comprising:

a conveyance section which conveys a recording medium in a conveyance direction;

a plurality of recording heads aligned along the conveyance direction of the recording medium, each of the recording heads ejects the same type of photo-curing ink onto the recording medium and each of the recording heads comprising a plurality of nozzles aligned in a nozzle array, each of the nozzles forms an image element on the recording medium, each nozzle in each of the plurality of nozzles in each of the recording heads is aligned, in the conveyance direction, with an immediate downstream nozzle in an immediate downstream recording head;

a plurality of light irradiating sections aligned along the conveyance direction of the recording medium, each of the irradiating sections provided immediately downstream of a respective one of each of the plurality of recording heads and irradiates light onto the recording medium to which the photo-curing type ink has been ejected by the respective one of each of the plurality of recording heads; and a control section controls the recording heads such that, for the image element formed on the recording medium at a first position in the conveyance direction, a recording head that is positioned downstream, in a conveyance direction, to a previous recording head ejects ink at positions shifted in a direction perpendicular to the conveyance direction by one image element from the positions of the ink ejected from the previous recording head.

2. The ink-jet recording apparatus of claim 1, further comprising:

a first recording head included in the plurality of recording heads, which ejects photo-curing type ink onto the recording medium conveyed by the conveyance section;

a first light irradiating section included in the plurality of light irradiating sections, which irradiates light onto the recording medium to which the photo-curing type ink has been ejected from the first recording head;

a second recording head included in the plurality of recording heads, which ejects the same kind of photo-curing type ink as the photo-curing type ink that has been ejected from the first recording head onto the recording medium to which the light has been irradiated by the first light irradiating section; and a second light irradiating section included in the plurality of light irradiating sections, which irradiates light onto the recording medium to which the photo-curing type ink has been ejected from the second recording head.

3. The ink-jet recording apparatus of claim 2, wherein each of the first and second recording head comprises a plurality of nozzles each ejecting the photo-curing type ink, and the photo-curing type ink ejected from the nozzles of the second recording head is deposited at a position on the recording medium that is shifted away by a predetermined amount from at least one of the conveyance direction of the recording medium and a direction in which the nozzles are aligned, with respect to a position at which the photo-curing type ink has been ejected from the nozzles of the first recording head.

4. The ink-jet recording apparatus of claim 3, wherein the recording head is driven by a multiple-phase driven method, and nozzle arrays, structured of the integer multiple number of phases to be driven, are aligned within each of the recording heads, in the conveyance direction of the recording medium.

5. The ink-jet recording apparatus of claim 4, wherein the number of phases to drive the recording heads is three, and recording heads are aligned in three lines in the conveyance direction of the recording medium.

6. The ink-jet recording apparatus of claim 3, wherein each of the plurality of nozzles of the recording head is aligned in a line.

7. An ink-jet recording apparatus comprising:

a conveyance section which conveys a recording medium in a conveyance direction;

a first group of a plurality of recording heads aligned along the conveyance direction of the recording medium, each of the recording heads ejects a first type of photo-curing ink onto the recording medium, and each of the recording heads of the first group comprising a plurality of nozzles aligned in a nozzle array, each of the nozzles forms an image element on the recording medium, each nozzle in each of the plurality of nozzles in each of the recording heads in the first group of recording heads is aligned, in the conveyance direction, with an immediate downstream nozzle in an immediate downstream recording head in the first group of recording heads;

a first group of a plurality of light irradiating sections aligned along the conveyance direction of the recording medium, each of the irradiating sections provided immediately downstream of a respective one of the plurality of recording heads and irradiates light onto the recording medium to which the photo-curing type ink has been ejected by the respective one of the first group of the plurality of recording heads, wherein a control section controls the first group of the recording heads such that, for the image element formed on the recording medium at a first position in the conveyance direction, a recording head that is positioned downstream, in a conveyance direction, to a previous recording head ejects ink at positions shifted in a direction perpendicular to the conveyance direction by one image element from the positions of the ink ejected from the previous recording head;

a second group of a plurality of recording heads, each of the recording heads ejects a second type of photo-curing ink onto the recording medium, each of the recording heads of the second group comprising a plurality of nozzle, each of the nozzles form an image element on the recording medium, each nozzle in each of the plurality of nozzles in each of the recording heads in the second group of recording heads is aligned, in the conveyance direction, with an immediate downstream nozzle in an immediate downstream recording head in the second group of recording heads;

a second group of a plurality of light irradiating sections, each of the irradiating sections is provided immediately downstream of a respective one of the plurality of recording heads and irradiates light onto the recording medium to which the photo-curing type ink has been ejected by the respective one of the second group of the plurality of recording heads, wherein the control section further controls the second group of the recording heads such that, the image element formed on the recording medium at a first position in the conveyance direction, a recording head that is positioned downstream in a conveyance direction, to a previous recording head ejects ink at positions shifted in a direction perpendicular to the conveyance direction by one image element from the positions of the ink ejected from the previous recording head.

* * * * *